US005312258A

United States Patent [19]

Giorgio

[11] Patent Number: 5,312,258

[45] Date of Patent: May 17, 1994

[54] DRY LAND SNOWBOARD TRAINING DEVICE

[75] Inventor: John D. Giorgio, Phoenix, Ariz.

[73] Assignee: Sam J. Mulay, Addison, Ill.; a part interest

[21] Appl. No.: 976,052

[22] Filed: Nov. 13, 1992

[51] Int. Cl.[5] ..... A63B 69/18

[52] U.S. Cl. ..... 434/253; 434/247; 280/7.12; 280/842; 482/71

[58] Field of Search ..... 434/247, 253, 255, 258; 280/842, 843, 7.12, 8, 7.14, 11.19; 482/51, 71

[56] References Cited

U.S. PATENT DOCUMENTS

| | | | |
|---|---|---|---|
| 2,253,012 | 8/1941 | Benner et al. | 280/11.10 |
| 2,260,027 | 10/1941 | Hotson | 280/11.10 |
| 2,485,756 | 10/1949 | Meehan | 280/7.13 |
| 3,522,951 | 8/1970 | Tyson | 280/11.10 |
| 3,622,172 | 11/1971 | Goodwin | 280/11.22 |
| 3,722,900 | 3/1973 | Dickert | 280/11.10 |
| 4,134,598 | 1/1979 | Urisaka | 280/11.22 |
| 4,700,958 | 10/1987 | Volpato | 280/11.10 |
| 4,728,116 | 3/1988 | Hill | 280/618 |
| 4,886,298 | 12/1989 | Shols | 280/842 |
| 4,898,403 | 2/1990 | Johnson | 280/842 |
| 4,979,760 | 12/1990 | Derrah | 280/607 |
| 5,044,654 | 9/1991 | Meyer | 280/613 |
| 5,096,225 | 3/1992 | Osawa | 280/842 |

FOREIGN PATENT DOCUMENTS

| | | | |
|---|---|---|---|
| 0564952 | 8/1975 | Switzerland | 482/71 |

*Primary Examiner*—Gene Mancene
*Assistant Examiner*—Jeffrey A. Smith
*Attorney, Agent, or Firm*—Laura J. Zeman; David G. Rosenbaum

[57] ABSTRACT

A dry land snowboard training device is presented for simulating the balance and movement of a conventional snowboard on dry land, and in particular the balance and movement of a conventional snowboard on a wooden half pipe. The device comprises a unitary retrofit apparatus which can be mounted to a footboard or removably mounted to a conventional snowboard. The retrofit apparatus includes a frame, a support brace, and a series of housing assemblies which each contain a plurality of ball bearings. The device also incorporates a pair of inventive bindings which each comprise a hard plastic sole, with straps, and a support piece, with a strap, which is attached to the hard plastic sole with flexible cords.

22 Claims; 2 Drawing Sheets

DRY LAND SNOWBOARD TRAINING DEVICE

BACKGROUND OF THE INVENTION

The present invention relates generally to a dry land snowboard training device. More particularly, the present invention relates to a device which simulates snowboarding on dry land by providing a retrofit device for a conventional snowboard, or a manufactured snowboard containing the retrofit device, which is designed for use on a half pipe made of plywood or other non-snow surfaces.

Although snowboarding is most closely associated with skiing, snowboard riders come to the sport from a number of other sports including skateboarding, surfing, and sailboarding. Snowboarding had its earliest recorded start in the mid-1960's. Since then, steady progress was made in improving snowboard materials, design, and construction until the early 1980's, when the technological advances in the ski industry were adapted to snowboarding.

Entering the 1990's, there is an estimated 2,000,000 snowboarders in the United States alone. In 1992, that number is expected to double. The number of snowboards manufactured and sold has also increased. In 1991–92, Burton, the leading manufacturer in snowboards, made and sold approximately 90,000 new snowboards while Morrow, another manufacturer, made and sold approximately 29,000 new snowboards.

At first, ski resorts were reluctant to allow snowboarding. However, after insurance companies for the ski resorts determined that there was no significant difference in the danger of injuries to downhill skiers and to snowboard skiers, the number of resorts allowing snowboarding increased drastically. In 1990, approximately 95% of all resorts allowed snowboarding while only 40% allowed snowboarding just three years prior to that.

Snowboarding has been named the largest growing professional sport in both the United States and the world. Along with the increase in the number of participants in the sport, there has also been an increase in the number of competitions available to snowboarders. Therefore, there is a definite need for a dry land snowboard which is capable of moving in multiple directions and simulating edging on snow, in order to provide a means for practicing snowboarding without the snow.

SUMMARY OF THE INVENTION

Accordingly, it is a principal object of the present invention to provide a dry land snowboard training device.

It is a further object of the present invention to provide a dry land snowboard training device designed for use on a half pipe made of plywood or other non-snow surfaces.

It is still a further object of the present invention to provide a dry land snow board with flexion that is substantially identical to that of a conventional snowboard on snow.

It is yet a further object of the present invention to provide a retrofit device which can be mounted to a conventional snowboard, or a manufactured snowboard which includes the retrofit device, for simulating the balance and motion of snowboarding on non-snow surfaces.

It is still a further object of the present invention to provide a snowboard training device for use on non-snow surfaces which comprises roller assemblies for simulating the omnidirectional movement of the snowboard on snow and removable and replaceable edges for simulating edging on snow.

It is still a further object of the present invention to provide a new and improved binding for the dry land snowboard device which includes a support piece flexibly attached to the shoe base plate of conventional soft boot bindings.

In brief, there is provided a retrofit molding apparatus which can be mounted to a conventional snowboard or included as part of a manufactured snowboard which includes an oblong shaped frame with a planar edging on the top surface of the frame and an "L" shaped edging on the bottom surface of the frame, a support brace mounted inside of the frame and in a flush position with the planar edging of the top surface of the frame, and a series of roller assemblies mounted onto the "L" shaped edging of the bottom surface of the frame. The oblong shaped frame further includes a series of removable and replaceable pieces which make up the side lengths of the oblong shaped frame. In addition, a new and improved soft boot binding is provided which includes a shoe base plate with at least two straps for securing a user's foot and ankle to the plate and a support piece attached to the shoe base plate by at least one flexible cord. The support piece further comprises at least one strap for securing a user's calf to the support piece.

The objects and advantages of this invention will appear more fully from the following more detailed description of the preferred embodiments of the invention made in conjunction with the accompanying drawings.

DETAILED DESCRIPTION OF THE PREFERRED EMBODIMENTS

Figure 1:
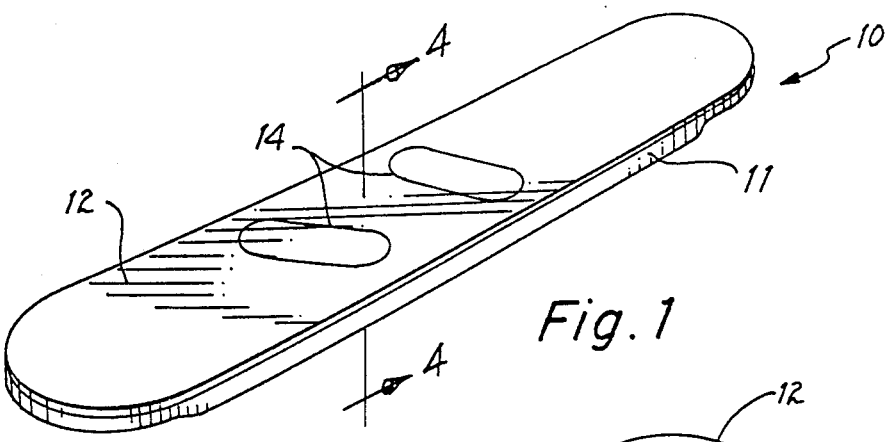
FIG. 1 is a top perspective view of the preferred embodiment of the inventive dry land snowboard apparatus of the present invention.

Referring now to FIG. 1, there is illustrated a dry land snowboard training device 10 made in accordance with the present invention. The dry land snowboard training device 10 includes a unitary retrofit apparatus 11 mounted to a footboard 12 which is similar in size and shape to a conventional snowboard. The illustration also shows foot positions 14 on the footboard 12 for a regular-footed stance which places the left foot forward.

Figure 2:
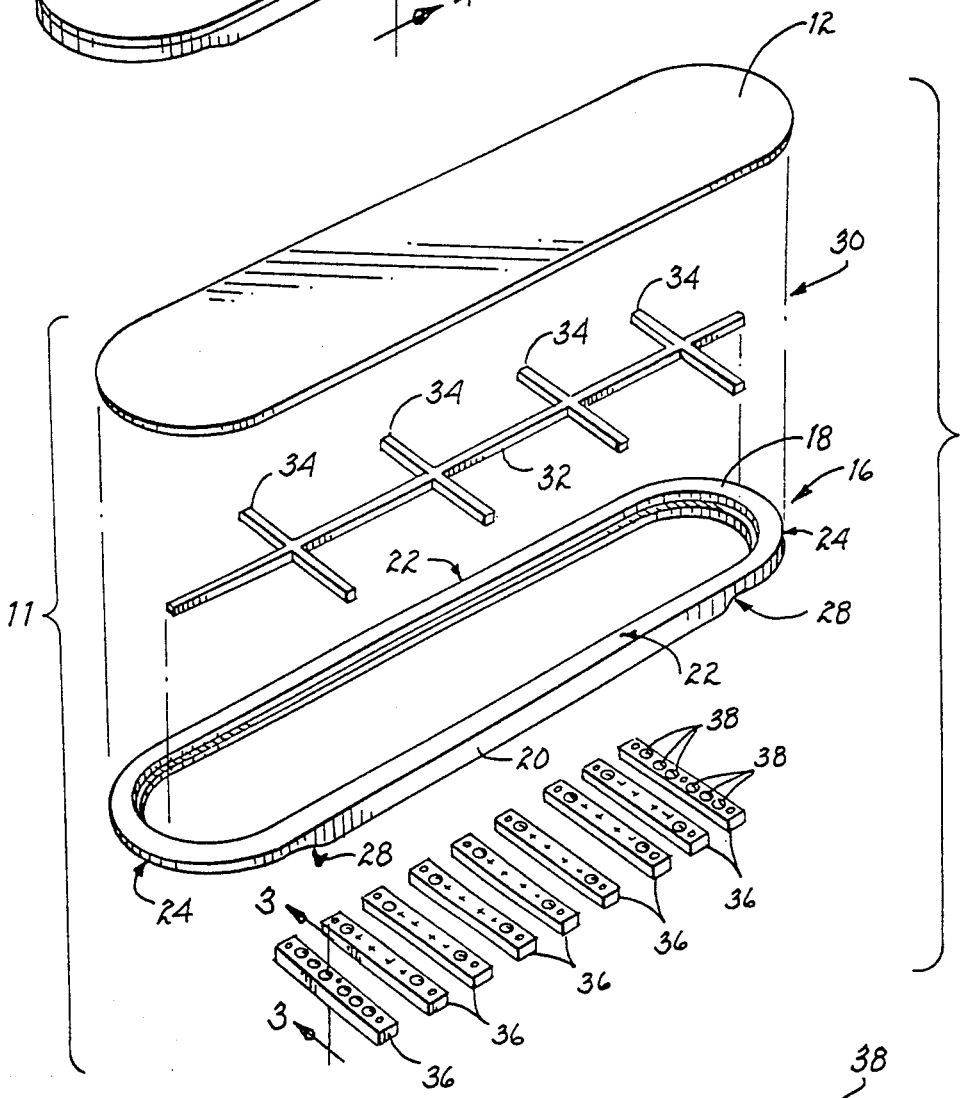
FIG. 2 is a top perspective view of the preferred embodiment of the inventive dry land snowboard apparatus of the present invention shown exploded.

FIG. 2 shows an exploded view of the dry land snowboard training device 10 in accordance with the best mode contemplated by the present invention. First, a substantially oblong shaped frame member 16 having a perimeter which is substantially equivalent to the perimeter of the footboard 12 is provided which comprises a horizontal member 18 and an upstanding vertical member 20 which result in an "L" shaped edging along the bottom surface of the frame member 16. The horizontal and upstanding vertical members 18, 20 which result in the "L" shaped edging are better seen in FIG. 5. The frame member 16 may be separated into two opposing linear side lengths 22 and two opposing curvilinear side lengths 24. The width of the upstanding vertical member 20 of the opposing linear side lengths 22 is greater than the width of the upstanding vertical member 20 of the opposing curvilinear side lengths 24 in order to facilitate simulating what is known as edging or sideslipping on a snow covered hill or incline.

The opposing linear side lengths 22 and the opposing curvilinear side lengths 24 may be removable to facilitate replacing those parts of the frame member 16 which become worn or damaged. This type of replacement is more cost effective and efficient than replacing the whole frame member 16. In addition, the opposing linear side lengths 22 and the opposing curvilinear side lengths 24 may themselves comprise removable and replaceable members. However, no matter how many removable and replaceable members are contained in the frame member 16, the frame member 16 should still retain a tapering effect of the upstanding vertical member 20 at those points 28 where the opposing linear side lengths 22 meet the opposing curvilinear side lengths 24.

A support brace 30 is mounted to the horizontal member 18 of the frame member 16 in order to provide a center support for the footboard 12. The support brace 30 comprises a lateral member 32 with a series of longitudinal members 34 uniformly spaced along the length of the lateral member 32. A series of housing members 36 are then mounted to the frame member 16 such that the ends of the housing members 36 rest on the "L" shaped edging on the bottom surface of the frame member 16 which is created by the horizontal member 18 and upstanding vertical member 20 of the frame member 16. Each of the housing members 36 contain a plurality of ball bearings 38, preferably hollow, which are slightly larger than their housing member 36.

Figure 3:
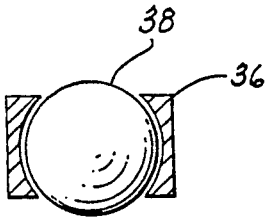
FIG. 3 is a cross-sectional view taken along line 3—3 of FIG. 2.

As illustrated in FIG. 3, each of the ball bearings 38 will extend outside of their housing 36 to enable the ball bearings 38 to make contact with dry land or other non-snow surfaces. In accordance with the best mode contemplated by the present invention, there are at least six ball bearings 38 contained in each housing member 36. Each ball bearing 38 is approximately three fourths inches in diameter and is preferably made of a low friction metal such as steel. In addition, the ball bearings 38 are preferably hollow in order to reduce the weight of the snowboard training device 10. After mounting the housing members 36 to the frame member 16, the ball bearings 38 will preferably reside approximately one sixteenth of an inch above the bottom surface of the frame member 16. The housing members 36 are preferably made of a strong, lightweight metal but may also be made of a strong plastic.

Figure 4:
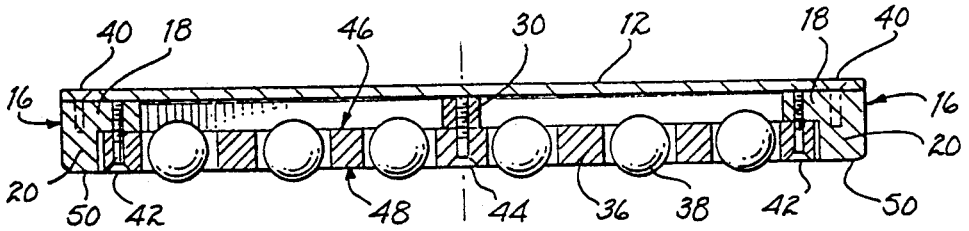
FIG. 4 is a cross-sectional view taken along line 4—4 of FIG. 1.

FIG. 4 shows a cross section of the preferred embodiment of the dry land snowboard training device 10 taken along line 4—4 of FIG. 1. The footboard 12 is shown mounted to the frame member 16 by screws 40. The housing member 36 is shown mounted to the bottom surface of the frame member 16 by bolts 42 and an additional bolt 44 secures the housing member 36 to the support brace 30. As previously described with reference to FIG. 3, each ball bearing 38 extends beyond the top surface 46 and the bottom surface 48 of its housing member 36.

Each housing member 36 is seated in the "L" shaped edging of the frame member 16 so that the bottom surface 48 of each housing member 36 is flush with or slightly below the bottom surface 50 of the upstanding vertical member 20 of the frame member 16. As a result of this seating, the ball bearings 38 extend slightly beyond the bottom surface 48 of the housing members 36 so that the ball bearings 38 alone, not the frame member 16 and the housing members 36, make contact with the dry land or wooden half pipe when the dry land snowboard training device 10 is evenly balanced. The total length of each housing member 36 is approximately ten inches in order to accommodate a footboard 12 which is twelve inches wide.

Figure 5:
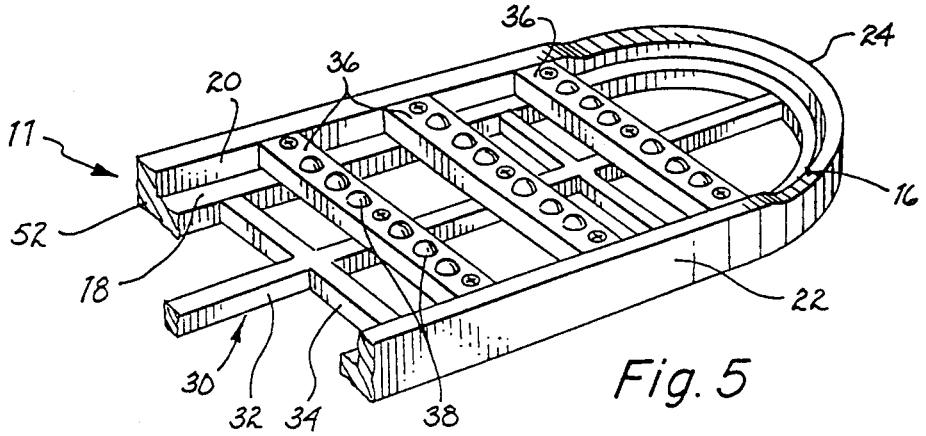
FIG. 5 is a bottom perspective view of one end of the preferred embodiment of the inventive dry land snowboard apparatus of the present invention.

A unitary retrofit apparatus 11 which can be removably mounted to a conventional snowboard is also contemplated by the present invention. FIG. 5 illustrates a bottom view of the unitary retrofit apparatus 11 which comprises a frame member 16 having an "L" shaped cross-section 52 with an upstanding vertical member 20 and a horizontal member 18, a support brace 30, and a series of housing members 36 which each contain a series of ball bearings 38. The linear side lengths 22 of the frame member 16, which enable a user to simulate edging on a non-snow surface, in particular on a wooden half pipe, are removable and replaceable. The curvilinear side lengths 24 of the frame member 16 may also be replaceable, but need not be in that they do not aid in simulating the edging or sideslipping effect of a conventional snowboard on snow. The entire unitary retrofit apparatus 11 is also removable and replaceable.

FIG. 5 also shows that the housing members 36 mounted to the frame member 16 and the lateral member 32 of the support brace 30 are spaced so that they do not cover the longitudinal members 34 of the support brace 30. This spacing allows a footboard 12, or a conventional snowboard mounted to the unitary retrofit apparatus 11, to flex along its longitudinal axis during use on dry land like that of a conventional snowboard during use on snow.

Figure 6:
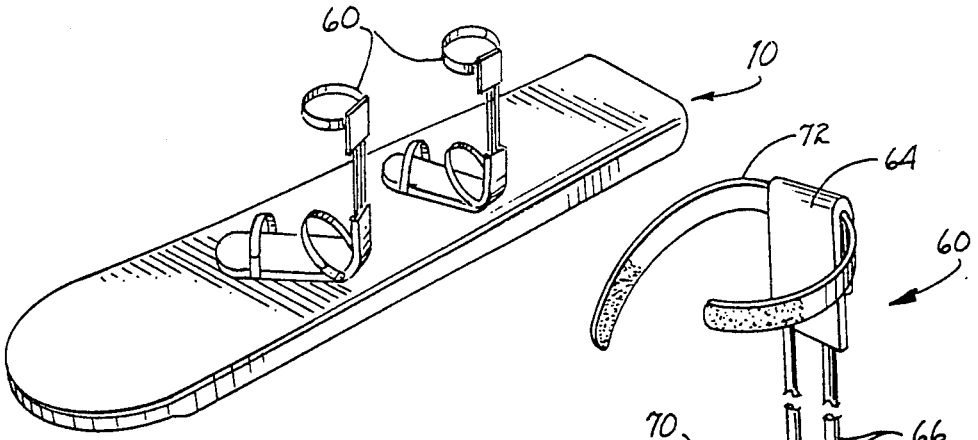
FIG. 6 is a top perspective view of the preferred embodiment of the inventive binding of the present invention shown mounted to the preferred embodiment of the inventive dry land snowboard of the present invention.

FIG. 6 illustrates the inventive bindings 60 of the present invention shown mounted to the preferred embodiment of the dry land snowboard training device 10. The details of the inventive bindings 60 are better seen in FIG. 7.

Figure 7:
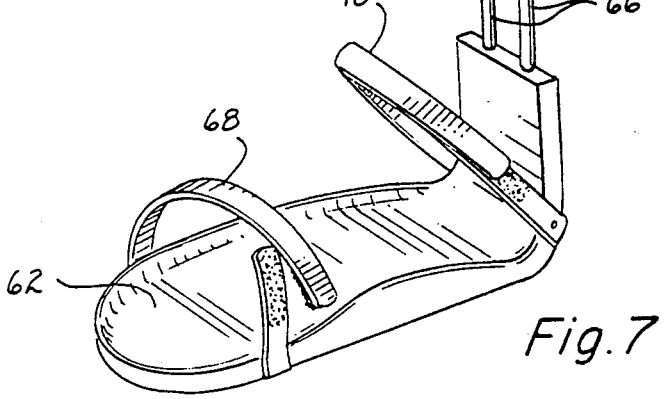
FIG. 7 is a perspective view of the preferred embodiment of the inventive binding of the present invention.

As shown in FIG. 7, the inventive binding 60 comprises a base plate member 62 which rests under the sole of a user's foot and curves up around the user's heel, a support piece 64 which is attached to the base plate member 62 by two flexible cords 66, and a series of straps 68, 70, 72. The area of the base plate member 62 which rests under the sole of the foot further comprises an upward curve which extends from the toe to the heel. A first strap 68 and a second strap 70 are attached to the base plate member 62 so that the first strap 68 can pass over the top of the user's foot and thereby secure the user's foot to the base plate member 62, and the second strap 70 can pass over the user's ankle and thereby secure the user's ankle to the base plate member 62. A third strap 72 is attached to the support piece 64 and wraps around a user's shin to secure the user's upper calf to the support piece 64.

The ends of the straps 68, 70, 72 are preferably attached to one another with Velcro or a quick release buckle to facilitate engaging a user's foot. The inventive bindings 60 can be used with all types of athletic shoes and are specifically designed for the dry land snowboard training device 10 of the present invention. In particular, the inventive bindings 60 are designed to hold the weight of the unitary retrofit apparatus 11 and a conventional snowboard or similarly shaped and weighted footboard 12 without straining a user's ankles.

In accordance with the best mode contemplated by the present invention, the frame member 16 and support brace 30 are preferably made of a strong molded plastic. Both the support brace 30 and the frame member 16 may constitute one molded piece or several molded pieces. The frame member 16 preferably comprises several molded pieces so that the opposing linear side lengths 22 of the frame member 16 which are used to simulate edging are easily removable and replaceable after being worn due to contact with the dry land or wooden half pipe. The housing members 36 may be made of a wire mesh, a plastic, or certain metals that are strong, or any other lightweight material which can be molded to retain the ball bearings 38. The ball bearings 38, as previously stated, are preferably hollow and made from a lightweight metal or steel. The footboard 12 is preferably made of materials similar to those materials which are used to create a conventional snowboard such as urethane wood, fiberglass, graphite, or polyethylene. The base plate member 62 and support piece 64 of the inventive bindings 60 are preferably made of a hard lightweight plastic while the strap members 68, 70,72 are preferably made of a strong woven fabric such as canvas or plastic.

While a preferred form of the invention has been shown in the drawings and described, since variations in the preferred form will be apparent to those skilled in the art, the invention should not be construed as limited to the specific form shown and described, but instead is as set forth in the following claims.

I claim:

1. A dry land snowboard apparatus for simulating the balance and movement of a snowboard on a non-snow surface comprising:

a substantially oblong shaped footboard having a top surface and a bottom surface;

a frame member mounted to said bottom surface of said footboard, said frame member having a perimeter which substantially corresponds to the shape of said footboard;

a support brace mounted inside of said frame member; and a plurality of roller assemblies mounted to said frame member for enabling omnidirectional movement of said footboard along the non-snow surface.

2. The apparatus of claim 1 wherein said frame member, said support brace, and said plurality of roller assemblies comprise a unitary retrofit sub-assembly which is removably mounted to said footboard.

3. The apparatus of claim 2 wherein said frame member comprises a vertical upstanding member and a lower horizontal member which thereby create a cross section of said frame member which is substantially "L"-shaped, said lower horizontal member being in contact with said footboard.

4. The apparatus of claim 3 wherein said support brace comprises a lateral member with a plurality of longitudinal members substantially uniformly spaced along a lengthwise aspect of said lateral member.

5. The apparatus of claim 4 wherein said plurality of roller assemblies each comprise a linear housing which holds a plurality of ball bearings, a surface of each of said plurality of ball bearings extending outside of said linear housing and above said vertical upstanding member of said frame member.

6. The apparatus of claim 5 wherein said frame member further comprises a series of removable and replaceable members.

7. The apparatus of claim 6 wherein said plurality of roller assemblies are laterally disposed along a top of said length of said lateral member of said support brace such that said plurality of longitudinal members of said support brace are located between said plurality of roller assemblies.

8. The apparatus of claim 7 wherein said plurality of ball bearings are hollow.

9. The apparatus of claim 8 further comprising a pair of bindings mounted on said footboard for engaging a user's feet.

10. The apparatus of claim 9 wherein each of said pair of bindings comprises at least two strap members mounted to a base plate member which curves around a user's heel and foot, a support piece attached to said base plate member by at least one flexible cord member, and a third strap member mounted to said support piece.

11. The apparatus of claim 10 wherein one of said at least two strap members passes over a top of the user's foot, another of said at least two strap members passes over a top of the user's ankle, and the third strap member passes over a shin of the user's leg.

12. A dry land snow board for simulating the balance and movement of a snowboard on a non-snow surface comprising:

a substantially oblong shaped footboard, of a same shape and size of said snowboard, having a top surface and a bottom surface;

a frame member mounted to said bottom surface of said footboard having a perimeter which substantially corresponds to the shape of said footboard, said frame member comprising a lower horizontal member and a vertical upstanding member wherein said lower horizontal member is in contact with said bottom surface of said footboard;

a support brace comprising a lateral member and a plurality of longitudinal members substantially uniformly spaced along a lengthwise aspect of said lateral member, said support brace being mounted inside of said frame member such that said support brace is in contact with said lower horizontal member of said frame member; and a plurality of roller assemblies each comprising a housing having a first end, a second end, a top surface, and a bottom surface, and a plurality of ball bearings contained in each said housing and extending beyond said top and bottom surfaces of each said housing, said roller assemblies being mounted to said frame member such that said roller assemblies are in contact with both said vertical upstanding member and said lower horizontal member of said frame member.

13. The apparatus of claim 12 wherein said frame member, said support brace, and said plurality of roller assemblies comprise a unitary retrofit sub-assembly which is removably mounted to said footboard.

14. The apparatus of claim 13 wherein said frame member is divided into two opposing linear side members and two opposing curvilinear side members.

15. The apparatus of claim 14 wherein the upstanding vertical member of said two opposing linear side members is greater in width than the upstanding vertical member of said two opposing curvilinear side members.

16. The apparatus of claim 15 wherein said two opposing linear side members and said two opposing curvilinear side members are removable and replaceable.

17. The apparatus of claim 16 wherein said two opposing linear side members and said two opposing curvilinear side members comprise removable and replaceable members.

18. The apparatus of claim 17 wherein said plurality of ball bearings are hollow.

19. The apparatus of claim 18 further comprising a pair of bindings mounted to said substantially oblong shaped footboard for engaging a user's feet.

20. The apparatus of claim 19 wherein each of said pair of bindings comprises at least two strap members mounted to a base plate member which curves around a heel of the user's foot, a support piece attached to said base plate member by at least one flexible cord member, and a third strap member mounted to said support piece.

21. The apparatus of claim 20 wherein one of said at least two strap members passes over a top of the user's foot, another of said at least two strap members passes over the top of the user's ankle, and the third strap member passes over a shin of the user's leg.

22. A method for simulating the balance and movement of a snowboard on a non-snow surface comprising the steps of:

mounting a frame member to a bottom surface of a footboard having substantially the same shape and size of a snowboard;

mounting a support brace inside of said frame member to allow for flexion across a longitudinal aspect of said snowboard and resist torsion flexion across a width of said snowboard;

mounting a plurality of roller assemblies to said frame member;

engaging a user's feet with a pair of bindings on a top surface of said snowboard; and employing an edge of said frame member by alternating balancing on a user's toes and heels.

* * * * *